US009109778B2

(12) United States Patent
Cohen

(10) Patent No.: US 9,109,778 B2
(45) Date of Patent: Aug. 18, 2015

(54) HANGING LANTERN WITH REMOVEABLE, INTERCHANGEABLE SHADES

(71) Applicant: RSR Sales, Inc., Ann Arbor, MI (US)

(72) Inventor: Richard Cohen, Ann Arbor, MI (US)

(73) Assignee: RSR Sales, Inc., Ann Arbor, MI (US)

( * ) Notice: Subject to any disclaimer, the term of this patent is extended or adjusted under 35 U.S.C. 154(b) by 29 days.

(21) Appl. No.: 13/973,056

(22) Filed: Aug. 22, 2013

(65) Prior Publication Data

US 2014/0055988 A1 Feb. 27, 2014

Related U.S. Application Data

(60) Provisional application No. 61/692,998, filed on Aug. 24, 2012.

(51) Int. Cl.

| | |
|---|---|
| ***F21L 4/08*** | (2006.01) |
| ***F21V 1/06*** | (2006.01) |
| ***F21V 17/06*** | (2006.01) |
| ***F21S 9/03*** | (2006.01) |
| ***F21V 3/02*** | (2006.01) |
| ***F21V 17/00*** | (2006.01) |
| *F21V 21/08* | (2006.01) |
| *F21Y 101/02* | (2006.01) |

(52) U.S. Cl.

CPC ... *F21V 1/06* (2013.01); *F21L 4/08* (2013.01); *F21S 9/03* (2013.01); *F21V 3/023* (2013.01); *F21V 17/002* (2013.01); *F21V 17/06* (2013.01); *F21V 21/08* (2013.01); *F21Y 2101/02* (2013.01); *Y10T 29/49117* (2015.01)

(58) Field of Classification Search

CPC ..... F21V 1/06; F21V 3/023; F21V 17/002; F21V 17/06; F21L 4/08; F21S 9/03; F21S 9/037

USPC ..... 362/183, 267, 352, 355, 356, 357, 363, 362/450

See application file for complete search history.

(56) References Cited

U.S. PATENT DOCUMENTS

| | | | | |
|---|---|---|---|---|
| 1,628,863 | A * | 5/1927 | Townsend | 362/437 |
| 7,073,919 | B1 * | 7/2006 | Masina | 362/356 |
| 7,513,638 | B2 | 4/2009 | Allsop et al. | |
| 8,192,044 | B2 | 6/2012 | Allsop et al. | |

FOREIGN PATENT DOCUMENTS

GB 274305 A * 7/1927

* cited by examiner

*Primary Examiner* — Y M Lee

(74) *Attorney, Agent, or Firm* — Gifford, Krass, Sprinkle, Anderson & Citkowski, P.C.

(57) ABSTRACT

A solar-powered hanging lantern includes an interchangeable shade. The article comprises a housing having an upper surface with a solar cell and a lower surface with a light source. A rechargeable battery and electronics within the housing charge the battery using the solar cell and illuminate the light source when ambient light falls to a predetermined level. The housing includes a cylindrical sidewall with a diameter and a peripheral rim extending outwardly form the cylindrical sidewall. A shade is provided having an upper, generally cylindrical opening slightly larger than the diameter of the housing, the shade being installed onto and over the housing such that the cylindrical opening rests on the peripheral rim, with an elastomeric ring being placed onto and over the housing to maintain the shade in position. The ring may be an O-ring and/or may include an inner groove to receive the opening of the shade.

4 Claims, 3 Drawing Sheets

HANGING LANTERN WITH REMOVEABLE, INTERCHANGEABLE SHADES

REFERENCE TO RELATED APPLICATION

This application claims priority to U.S. Provisional Application Ser. No. 61/692,998, filed Aug. 24, 2012, the entire content of which is incorporated herein by reference.

FIELD OF THE INVENTION

This invention relates generally to hanging lanterns and, in particular, to lanterns with removable, interchangeable shades.

BACKGROUND OF THE INVENTION

FIG. 1 is a drawing of a prior art illuminated hanging lantern 100 with a paper or plastic shade 102. The shade 102 is collapsible, with a helical embedded wire 118 typically included to maintain its shape when expanded to a generally spherical shape. For illumination, the configuration includes a body 104 having a solar cell 106 and a light source such as LED 108. The electronics to transfer electrical power from the solar panel to the LED are contained in the body 104, which hangs via hook 110. The solar cell 106 or optional photocell may be used to detect lower ambient light levels so that the lantern only becomes illuminated at dusk. Some designs include a metal retaining wire 116 to keep the shade expanded. The shade 102 has an upper, peripheral round hole that is trapped by an upper rim 112 of body 104 and a lower retaining ring 114. The ring 114 is either screwed or glued in position such that shade 102 cannot be removed. As such, the shade 102 is not interchangeable if it becomes soiled or damaged.

SUMMARY OF THE INVENTION

This invention improves upon the existing art by providing a solar-powered hanging lantern with an interchangeable shade. The article comprises a housing having an upper surface with a solar cell and a lower surface with a light source. A rechargeable battery and electronics within the housing charge the battery using the solar cell and illuminate the light source when ambient light falls to a predetermined level. The housing includes a cylindrical sidewall with a diameter and a peripheral rim extending outwardly from the cylindrical sidewall. A shade is provided having an upper, generally cylindrical opening slightly larger than the diameter of the housing, the shade being installed onto and over the housing such that the cylindrical opening rests on the peripheral rim, with an elastomeric ring being placed onto and over the housing to maintain the opening of the shade against the peripheral rim of the housing. The ring may be an O-ring with a circular, rectangular or other cross section, and/or may include an inner groove to receive the opening of the shade. The shade may be collapsible between a flattened shape and a generally spherical shape.

DETAILED DESCRIPTION OF THE INVENTION

Figure 1:
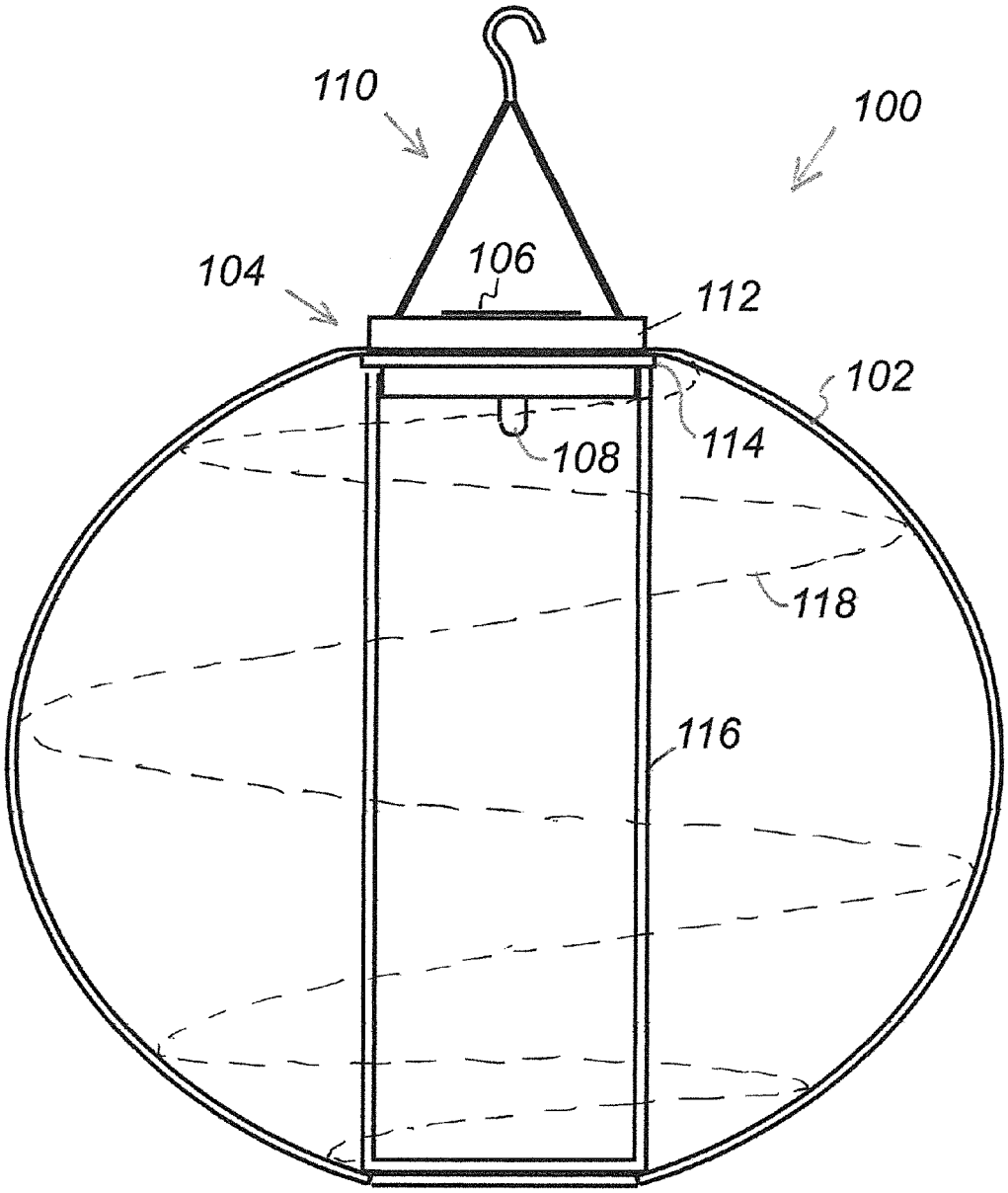
FIGURE 1 (PRIOR ART)
FIG. 1 is a drawing of a prior art hanging lantern with an expanding shade.
Figure 2A:
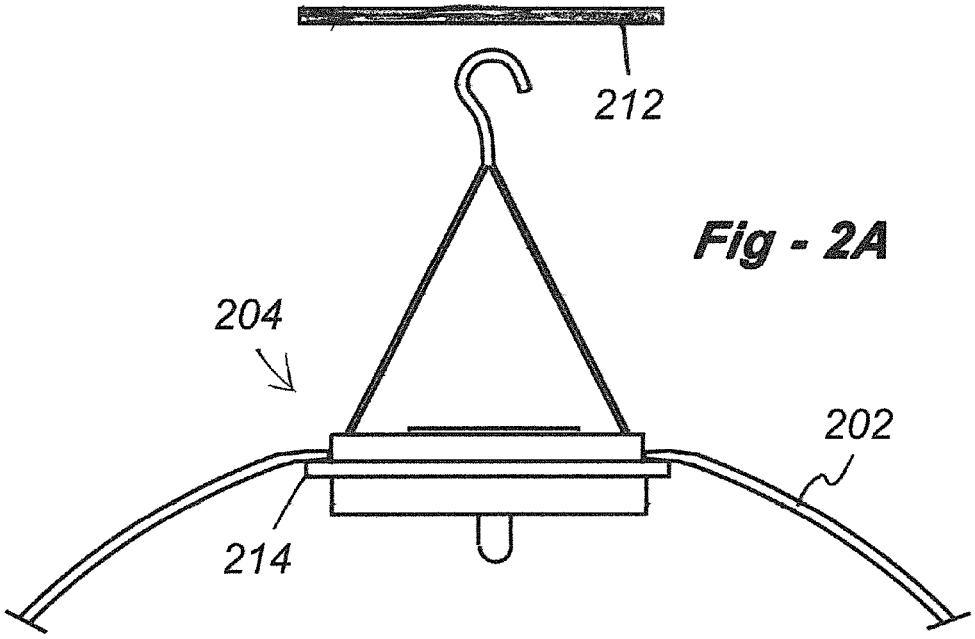
FIG. 2A shows a preferred embodiment of the invention prior to assembly.
Figure 2B:
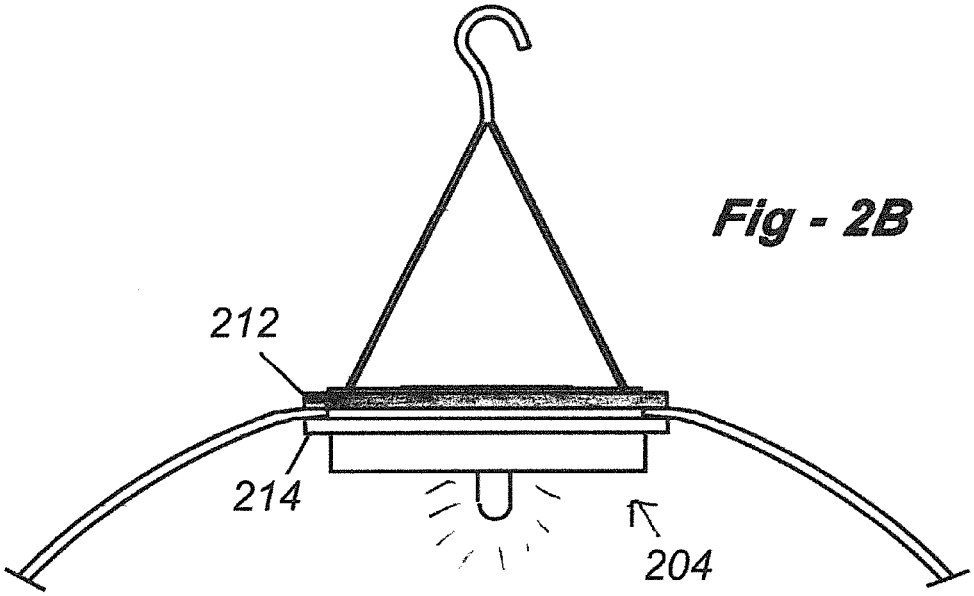
FIG. 2B shows the components of FIG. 2A in an assembled state.

This invention improves upon existing solar-powered hanging lanterns like the one described with reference to FIG. 1 by including components enabling the shade to be removed. The preferred embodiment is shown in FIGS. 2A and 2B. FIG. 2A shows the components prior to assembly, and FIG. 2B shows the components in an assembled state. The body 204 in this case includes a rim 214 projecting radially outwardly from the body. The shade 202 is fitted over this rim, and an elastomeric ring 212 is placed over the shade, keeping it in position. This way, the shade is not permanently or semi-permanently attached to the body and may be interchanged due to wear, discoloration or differing environments. The elastomeric O-ring 212 is simply removed, enabling the shade 202 to be swapped out for a new or different one.

Figure 3A:
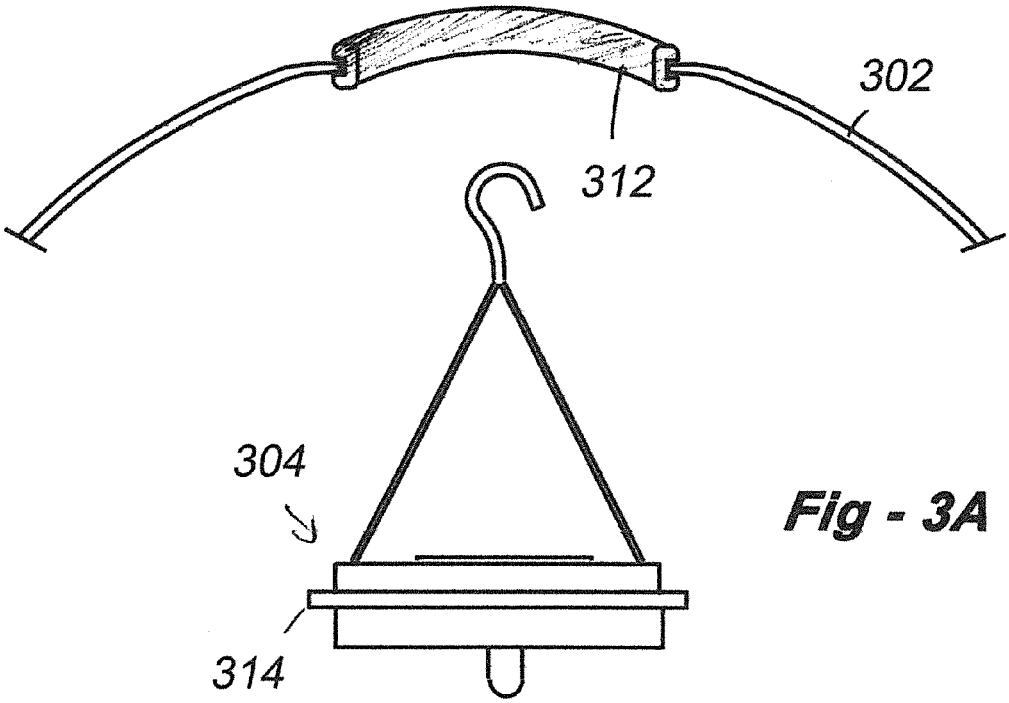
FIG. 3A shows an alternative embodiment of the invention prior to assembly.
Figure 3B:
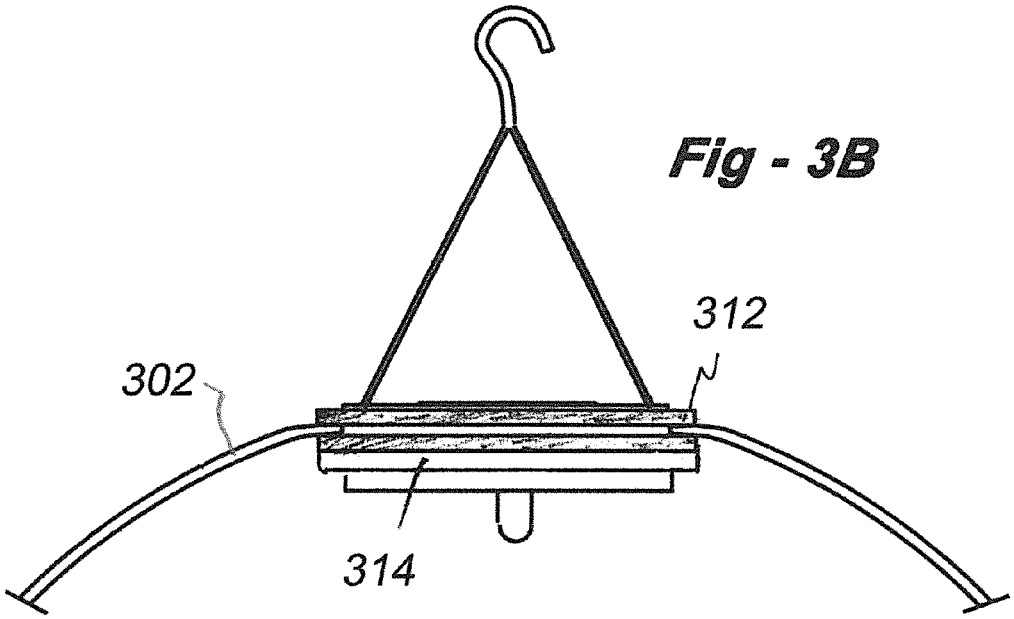
FIG. 3B shows the components of FIG. 3A in an assembled state.

An alternate embodiment is shown in FIGS. 3A and 3B. FIG. 3A shows the components prior to assembly, and FIG. 3B shows the components in an assembled state. The body 304 in this case also includes a rim 314 projecting radially outwardly from the body. The elastomeric ring 312 in this embodiment has an inner groove to receive the peripheral edge of the opening in the shade. Once this ring is fitted onto the shade, the combination is placed over the body, keeping it in position. Again, the shade may now be and interchanged, as desired.

The invention claimed is:

1. A solar-powered hanging lantern with an interchangeable shade, comprising:

a housing having an upper surface with a solar cell and a lower surface with a light source;

a rechargeable battery and electronics within the housing to charge the battery using the solar cell and illuminate the light source when ambient light falls to a predetermined level;

the housing including a cylindrical sidewall with a diameter and a peripheral rim extending outwardly from the cylindrical sidewall;

a shade having an upper, generally cylindrical opening slightly larger than the diameter of the housing, the shade being installed onto and over the housing such that the cylindrical opening rests on the peripheral rim;

an elastomeric ring placed onto and over the housing to maintain the opening of the shade against the peripheral rim of the housing; and wherein the ring includes groove to receive the opening of the shade.

2. The solar-powered lantern of claim 1, wherein the shade is collapsible between a flattened shape and a generally spherical shape.

3. A method of installing a shade onto a hanging lantern, comprising the steps of:

providing a housing having an upper surface with a solar cell and a lower surface with a light source, the housing including a rechargeable battery and electronics to charge the battery using the solar cell and illuminate the light source when ambient light falls to a predetermined level, the housing further including a cylindrical sidewall with a diameter and a peripheral rim extending outwardly from the cylindrical sidewall;

providing a shade having an upper, generally cylindrical opening slightly larger than the diameter of the housing;

installing the shade onto and over the housing such that the cylindrical opening rests on the peripheral rim;

placing an elastomeric ring onto and over the housing to maintain the opening of the shade against the peripheral rim of the housing; and wherein the ring includes an inner groove received by the opening of the shade.

4. The method of claim 3, including the step of expanding the shade from a flattened shape into a generally spherical shape.

* * * * *